US008549680B1

(12) United States Patent
Nichols

(10) Patent No.: US 8,549,680 B1
(45) Date of Patent: Oct. 8, 2013

(54) PORTABLE TODDLER MAT

(76) Inventor: Wendy Nichols, Marion, AL (US)

( * ) Notice: Subject to any disclaimer, the term of this patent is extended or adjusted under 35 U.S.C. 154(b) by 350 days.

(21) Appl. No.: 12/813,058

(22) Filed: Jun. 10, 2010

(51) Int. Cl.
*A47D 7/01* (2006.01)

(52) U.S. Cl.
USPC ..... 5/418; 5/655; 5/420

(58) Field of Classification Search
USPC ..... 5/418, 655, 420; 190/1; 244/577
See application file for complete search history.

(56) References Cited

U.S. PATENT DOCUMENTS 5,035,013 A 7/1991 Bloom
5,110,219 A 5/1992 Lopes
5,370,460 A 12/1994 Nelson
5,473,785 A 12/1995 Lager et al.
6,053,634 A 4/2000 Kay
6,199,230 B1 3/2001 Parikh
7,520,010 B2 4/2009 Welch
2005/0204471 A1 9/2005 Ruiz

*Primary Examiner* — Robert G Santos
*Assistant Examiner* — Brittany Wilson
(74) *Attorney, Agent, or Firm* — Montgomery Patent & Design, LLC; Robert C. Montgomery

(57) ABSTRACT

A protective pad for infants and toddlers to lie upon when away from home comprises a large rectangular textile assembly similar in size to a beach towel having a water-resistant bottom surface, a comfortable inner layer of foam rubber, and a top layer of soft fabric. The top layer is held in place via a perimeter zipper which enables removal and laundering thereof. The pad is provided with a raised foam rubber edge to serve as a barrier to dirt and debris. The pad may be folded up compactly and secured using hook-and-loop-type fasteners and transported or attached to a stroller using a pair of carrying handles. The pad also provides an on-board stake-style umbrella to provide shade for an occupying infant or toddler at park or beach settings.

18 Claims, 5 Drawing Sheets

PORTABLE TODDLER MAT

RELATED APPLICATIONS

The present invention was first described in a notarized Official Record of Invention on Aug. 12, 2009, that is on file at the offices of Montgomery Patent and Design, LLC, the entire disclosures of which are incorporated herein by reference.

FIELD OF THE INVENTION

The present invention relates generally to infant mats, and in particular, to a portable, collapsible mat which provides a comfortable and protective resting and playing means for an infant or toddler.

BACKGROUND OF THE INVENTION

Children and infants are delicate beings that require the utmost care in order to protect them and keep them safe from harm. As a result, there is a myriad of products intended to provide protection from the dangers generated by a variety of sources. Car seats protect them from physical harm while riding in a car and sun shades shield their eyes and skin from the harmful effects of ultraviolet light. Child proof toys protect them while playing and walkers support them and guard against falls while learning to walk.

While there appears to be a product intended to protect infants and toddlers from a seemingly endless list of dangers, one area where physical protection has been surprisingly lacking is when the infant is simply lying upon a floor. Indoor locations subject the child to dirt, hard flooring, rough carpets and the like, while outdoor locations pose a danger from sand, dirt, insects, chemicals and so forth.

Various attempts have been made to provide portable mats for infants or toddlers. Examples of these attempts can be seen by reference to several U.S. patents. U.S. Pat. No. 5,035,013, issued in the name of Bloom, describes a portable infant play mat with a cushioned base portion.

U.S. Pat. No. 5,370,460, issued in the name of Nelson, describes a foldable mat with handle portions for conversion into a conventional tote type bag.

U.S. Pat. No. 6,199,230, issued in the name of Parikh, describes an infant play corral with foam block walls which provides traditional play pen-type capabilities while providing a folding and locking means for transport and storage.

While these devices fulfill their respective, particular objectives, each of these references suffer from one (1) or more of the aforementioned disadvantages. Many such devices are not tightly collapsible to provide a minimum volume for storage and transport. Also, many such devices are not easily washable, replaceable, or modular to provide a variety of functionality. Furthermore, many such devices are not suitable for use in adverse conditions such as outdoor surfaces, egregious sunlight, wet conditions, and the like. Accordingly, there exists a need for a portable toddler mat without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide an easily transportable mat which provides a toddler or infant with comfort and protection in a plurality of locations and situations. Thus, the object of the present invention is to solve the aforementioned disadvantages and provide for this need.

To achieve the above objectives, it is an object of the present invention to provide a portable protective padded surface for an infant or toddler to lie or play upon. The apparatus comprises a large rectangular textile mat assembly.

Another object of the present invention is to provide for easy hand transport, storage, and attachment to a stroller or similar structure. An exterior portion of the apparatus provides a pair of shoulder straps for carrying or attachment when in a folded configuration.

Yet still another object of the present invention is to act as an effective barrier to moisture, soil and the like while resting on a ground surface. A bottom surface of the mat assembly comprises a waterproof fabric panel.

Yet still another object of the present invention is to provide a barrier to dirt and debris. The mat assembly comprises a raised padded edging when in a deployed state.

Yet still another object of the present invention is to provide comfort to an infant or toddler via a removable foam rubber insert.

Yet still another object of the present invention is to allow easy insertion and removal of the foam rubber insert via a conventional zipper assembly disposed around a perimeter edge of an upper layer of the mat assembly.

Yet still another object of the present invention is to allow a user to wash the upper layer of the mat assembly and removable foam insert. The upper layer is similarly removable via the zipper assembly.

Yet still another object of the present invention is to provide shade and covering protective functions to an infant or toddler via a conventional stake-type umbrella assembly.

Yet still another object of the present invention is to provide conventional umbrella features and protections including collapsibility, anchoring means, and the like.

Yet still another object of the present invention is to provide integral attachment for the umbrella assembly via an integral umbrella tube which further supports the umbrella in a protective position along with anchoring in a ground surface.

Yet still another object of the present invention is to provide for secure storage and transport of the apparatus via a plurality of integral straps and anchors which maintain the apparatus in a compact flat and folded state.

Yet still another object of the present invention is to provide a method of utilizing the device that provides a unique means of transporting the apparatus via the carrying straps, adjusting the straps as desired, deploying the apparatus by releasing the integral straps and anchors, laying the mat assembly along a ground surface in a desired location, utilizing the umbrella to provide shade and protection if desired, and easily collapsing and securing the apparatus in a folded state for subsequent transport and storage.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
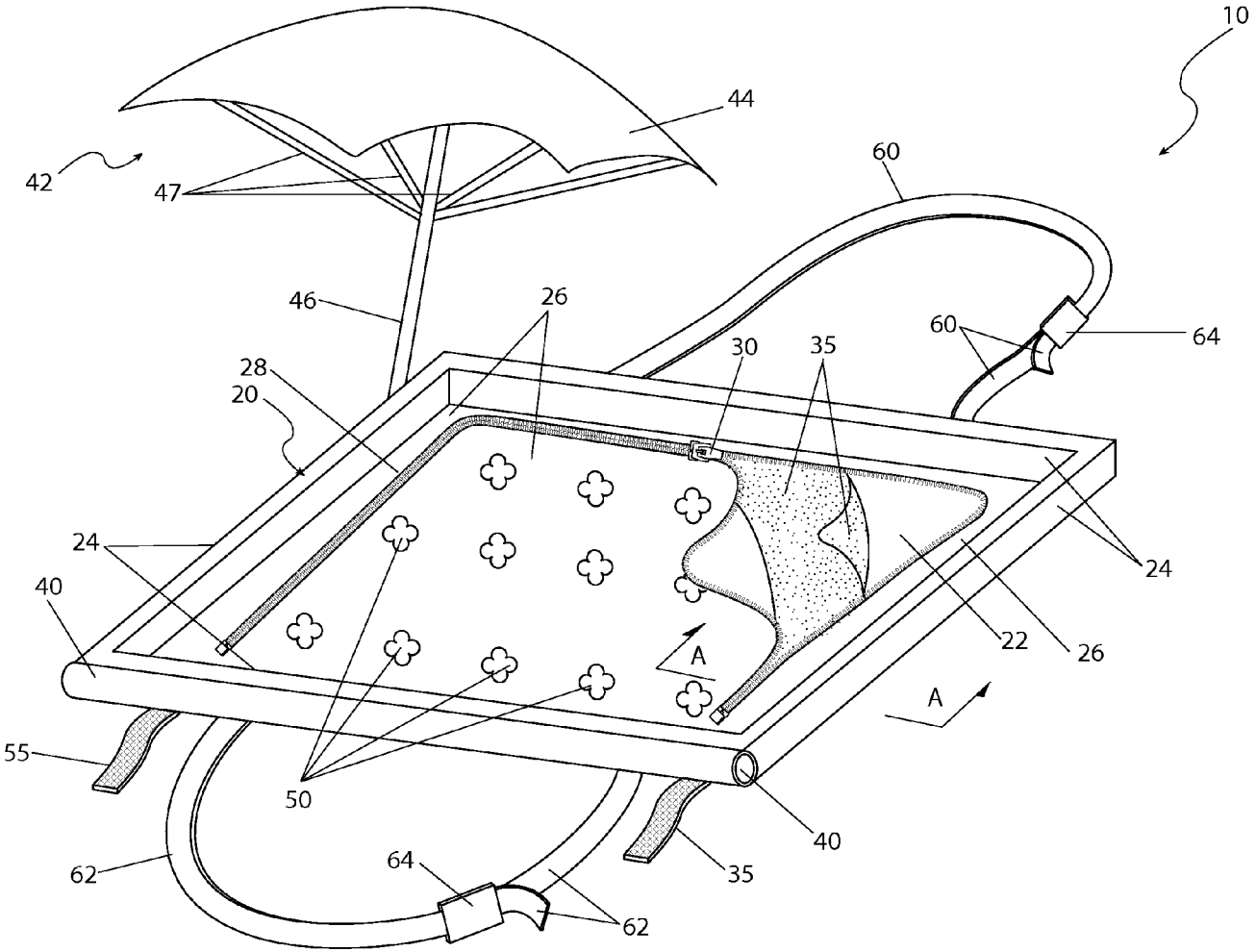
FIG. 1 is a perspective view of a portable toddler mat 10, according to a preferred embodiment of the present invention.

| DESCRIPTIVE KEY | |
|---|---|
| 10 | portable toddler mat |
| 20 | mat assembly |
| 22 | bottom layer |
| 24 | padded edging |
| 25 | padding |
| 26 | upper layer |
| 28 | zipper |
| 30 | zipper puller |
| 35 | foam insert |
| 40 | umbrella tube |
| 42 | umbrella |
| 44 | canopy |
| 46 | stake |
| 47 | frame |
| 50 | decorative motif |
| 55 | hook-and-loop strap portion |
| 57 | hook-and-loop anchor portion |
| 60 | first carrying strap |
| 62 | second carrying strap |
| 64 | strap adjustment fitting |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a device and method for a portable toddler mat (herein described as the "apparatus") 10, which provides a protective ground-level padded surface for an infant or toddler to lie or play upon when away from home. The apparatus 10 comprises a large rectangular textile mat assembly 20 similar in size to a beach towel comprising a water-resistant bottom layer 22, a soft upper layer 26, and a removable foam rubber insert 35 which provides added comfort. The apparatus 10 is provided with a raised padded edging 24 which provides a barrier to dirt and debris. The apparatus 10 may be compactly folded into four (4) rectangular sections and fastened using a plurality of hook-and-loop-type straps 55. The apparatus 10 also comprises a pair of shoulder straps 60, 62 for easy transportation or attachment thereto a stroller. The apparatus 10 also provides an on-board stake-style umbrella 42 which may be utilized to provide shade for an occupying infant or toddler.

Figure 2:
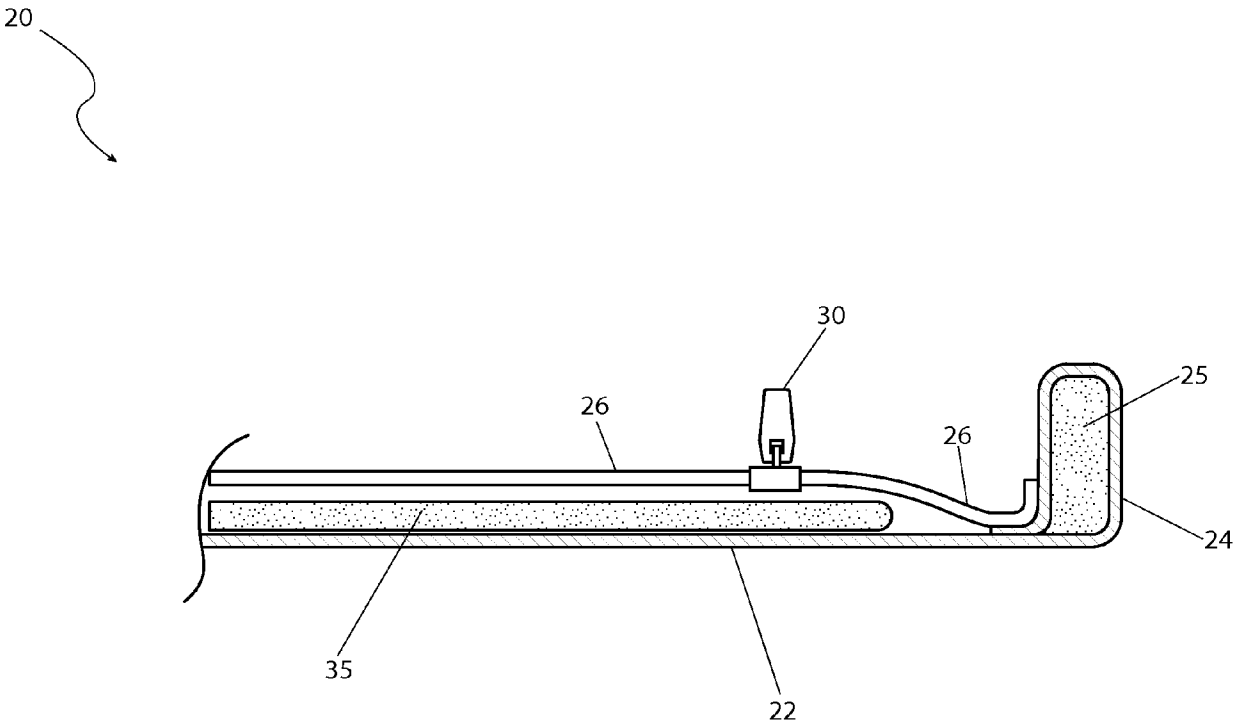
FIG. 2 is a section view of the portable toddler mat 10 taken along section line A-A (see FIG. 1), according to a preferred embodiment of the present invention.

Referring now to FIGS. 1 and 2, a perspective view and a section view of the apparatus 10, according to a preferred embodiment of the present invention, are disclosed. The mat assembly portion 20 of the apparatus 10 comprises a sewn or adhesive bonded multi-layered rectangular textile assembly comprising a water-resistant bottom layer 22, a soft upper layer 26, and a removable foam rubber insert 35.

The bottom layer 22 provides a horizontal fabric panel along a bottom surface preferably made using a plastic or latex coated cotton fabric which acts as an effective barrier thereto moisture, soil, and the like, while the apparatus 10 is resting upon a ground surface during use. The bottom layer 22 comprises a padded perimeter edge 24 which protrudes upwardly approximately one (1) inch and encapsulates a linear portion of foam rubber padding 25, thereby providing a soft compliant barrier thereto said moisture and soil.

The soft upper layer 26 comprises a similar perimeter shape as the bottom layer 22 being sewn or adhesively bonded thereto said bottom later 22 around an inner edge of the aforementioned padded edging 24, thereby forming a flat space between said bottom 22 and upper 26 layers. The upper layer 26 provides access thereto the flat space formed between said bottom 22 and upper 26 layers via a common plastic or metal zipper 28 and provides normal manipulation via a single zipper puller 30. Said zipper 28 extends around three sides of a perimeter edge of an upper surface of the upper layer 26 being indented from the padded edging 24 approximately one (1) inch. Unzipping of the zipper 28 enables insertion and removal of a foam rubber insert 35 between the bottom 22 and upper 26 layers. The foam rubber insert 35 is envisioned to be made using urethane foam or equivalent soft material providing a comfortable lying and playing surface for an occupying infant or toddler. The perimeter zipper 28 also enables the upper layer 26 and foam rubber insert 35 to be removed for washing.

The bottom 22 and upper 26 layers are envisioned to be introduced having a variety of decorative motifs 50 thereupon external surfaces depicting a variety of colors, patterns, scripts, logos, and the like, based upon a user's preference.

Figure 3A:
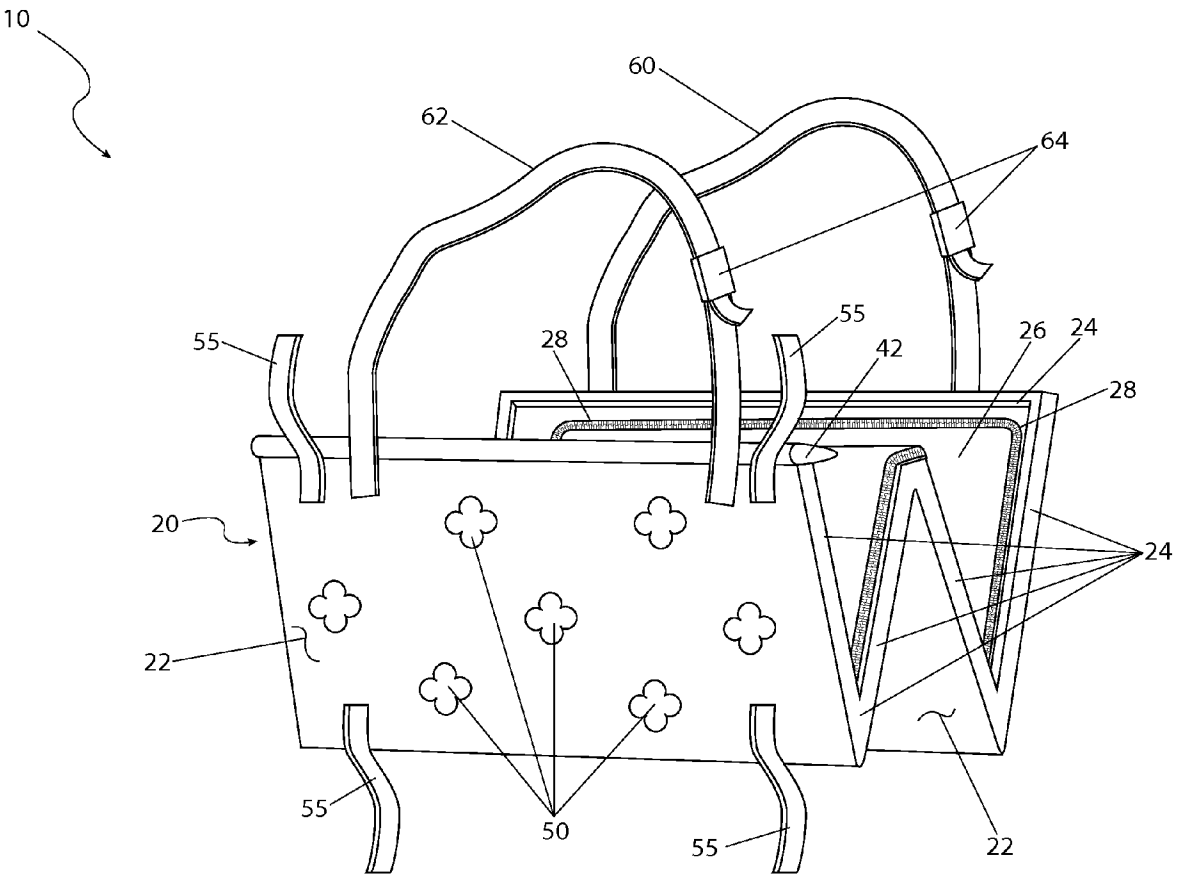
FIG. 3*a* is a perspective view of the portable toddler mat 10 depicting a partially collapsed state, according to a preferred embodiment of the present invention.
Figure 3B:
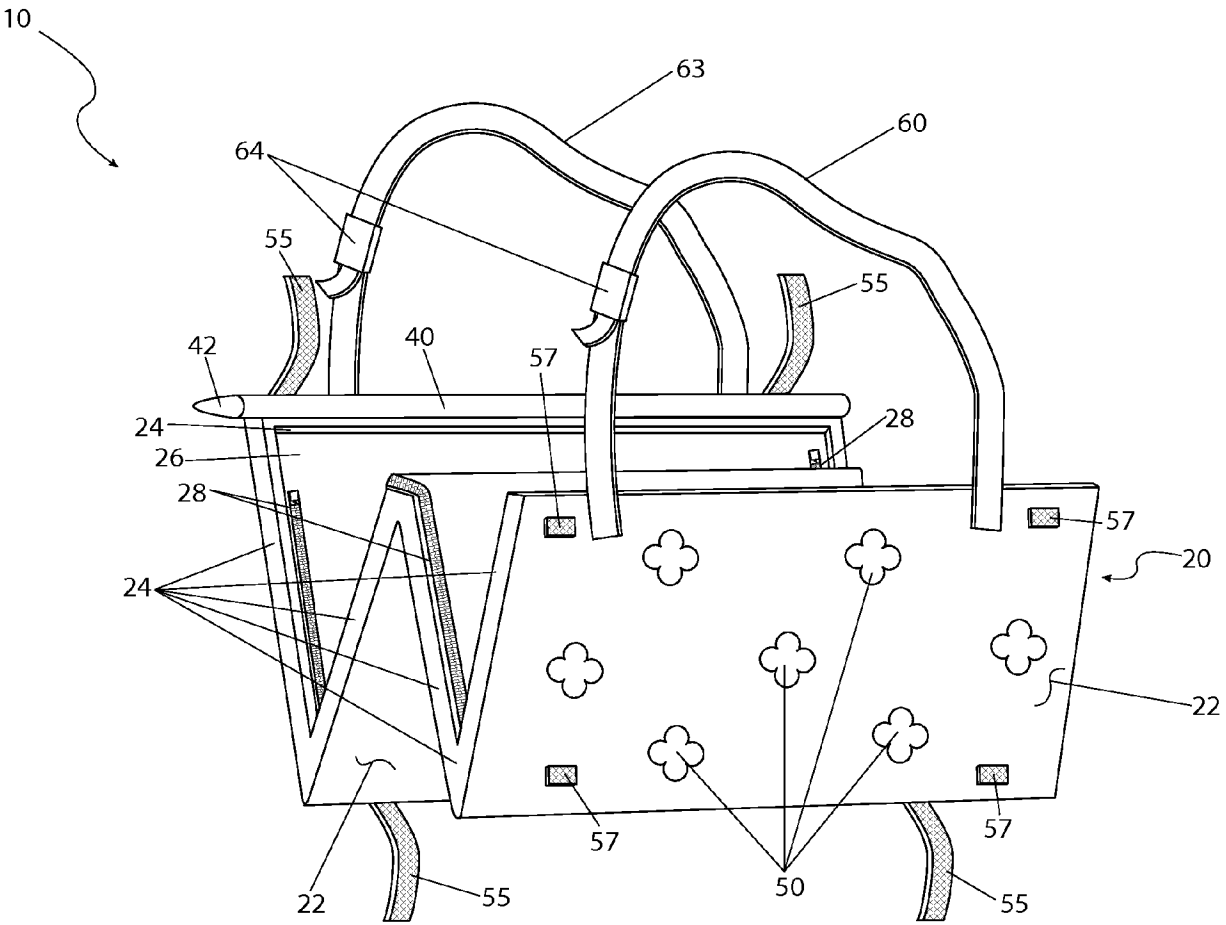
FIG. 3*b* is a perspective view of the opposing side of the portable toddler mat 10 depicting a partially collapsed state, according to a preferred embodiment of the present invention; and, FIG. 4 is another perspective view of the portable toddler mat 10 depicting a collapsed and stowed state, according to a preferred embodiment of the present invention.
Figure 4:
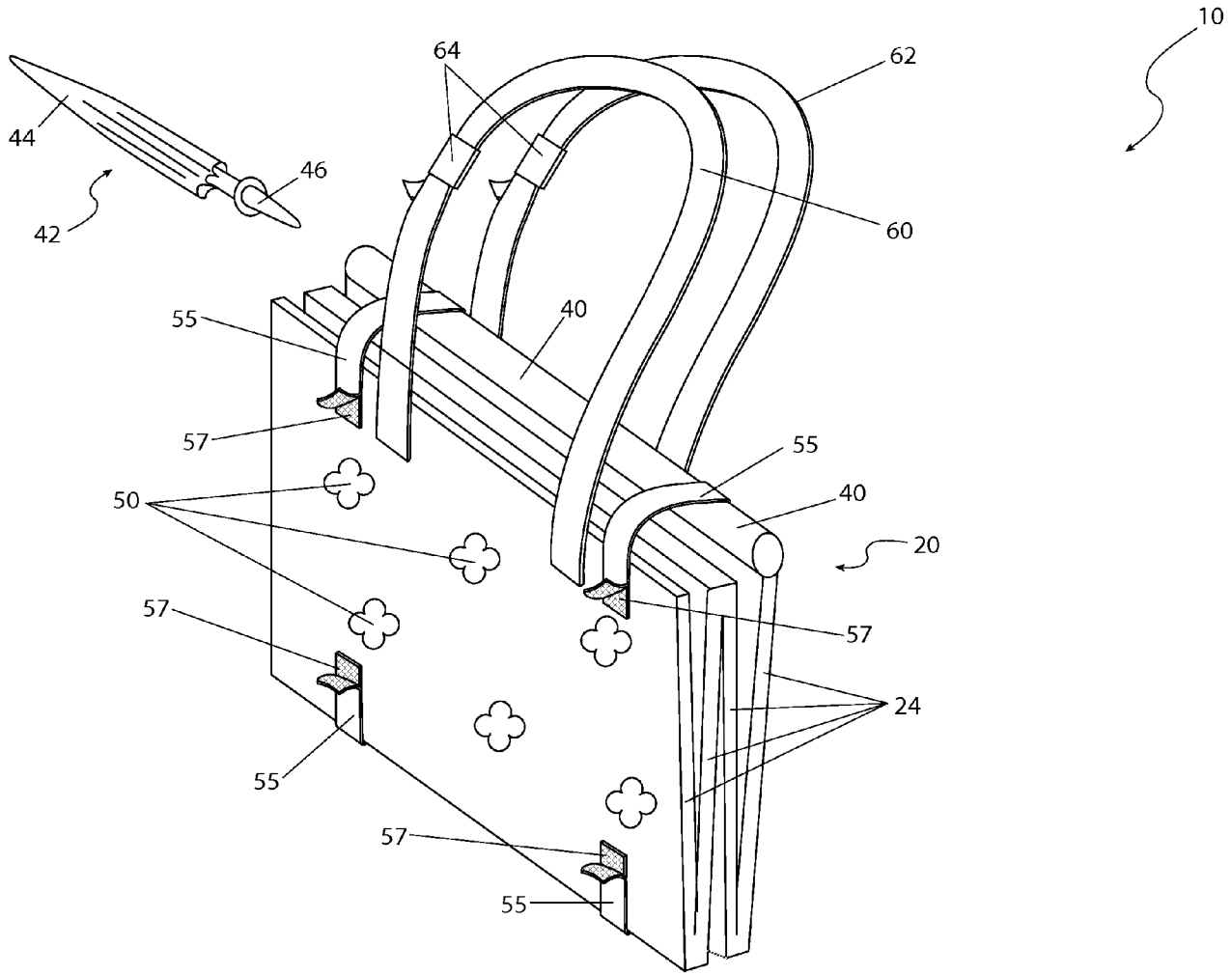

Referring now to FIGS. 3*a* through 4, perspective views of the apparatus 10 depicting partially collapsed and completely collapsed states, according to the preferred embodiment of the present invention, are disclosed. The apparatus 10 comprises an umbrella tube 40, an umbrella 42, a plurality of hook-and-loop strap portions 55, a first carrying strap 60, and a second carrying strap 62. The umbrella tube 40 comprises a cylindrical textile structure having one (1) open end portion suitable in size so as to slidingly receive a collapsed stake-type umbrella 42 snuggly into. The stake-type umbrella 42 comprises a similar construction and function as larger umbrellas suitable for penetrating and anchoring into a sandy or soil ground surface. Said umbrella 42 comprises expected features including a collapsible canopy 44, a pointed metal stake portion 46, and a locking internal frame 47. Said umbrella tube 40 is affixed thereto an upper edge of the mat assembly 20 being preferably sewn thereto using conventional textile assembly processes. The apparatus 10 may be compactly folded up and secured via a plurality of hook-and-loop straps 55 affixed and extending from top and bottom edges of the mat assembly 20. Said hook-and-loop straps 55 are removably attached in place via correspondingly positioned hook-and-loop anchor portions 57 sewn thereto the bottom layer of the mat assembly 20. Said hook-and-loop straps 55 and hook-and-loop anchor portions 57 allow a user to fold and secure the apparatus 10 in a compact flat state for transportation and/or storage as shown here.

Each carrying strap 60, 62 comprise a pair of linear textile elements made of durable sewn fabrics being joined together by a length adjusting fitting 64 and sewn thereat end portions to upper edges of the bottom layer 22. The carrying straps 60, 62 comprise a pair of parallel looping portions of suitable length so as to extend over a user's shoulder or may be attached thereto a stroller allowing normal transportation thereof. The length adjusting fittings 64 are envisioned to comprise common commercially available plastic fittings such as a tri-glide, a slide fitting, or the like.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1 through 4.

The method of installing and utilizing the apparatus 10 may be achieved by performing the following steps: procuring a particular model of the apparatus 10 having a decorative motif 50 in the form of a desired color, pattern, script, logo, and the like; transporting the apparatus 10 using the carrying straps 60, 62, thereto a desired location for an infant or toddler to play or lay upon; adjusting a length of said carrying straps 60, 62 using the strap adjustment fittings 64 to obtain a desired fit; deploying the apparatus 10 by releasing the hook-and-loop strap portions 55 from the respective hook-and-loop anchoring portions 57 to enable unfolding of the mat assembly 20; laying the mat assembly 20 flatly thereupon a ground surface at a park, beach, or the like; utilizing the umbrella 42 to produce a shaded effect, if desired, by slidingly removing said umbrella 42 from the umbrella tube 40; penetrating and anchoring the stake portion 46 of the umbrella 42 into an adjacent sandy or soil ground surface; deploying a canopy portion 44 of the umbrella 42 in a normal manner so as to cast a shadow over the apparatus 10 and occupying infant; placing the infant or toddler thereupon the apparatus 10 for a desired period of time to play, explore, sleep, or the like; removing the infant or toddler from the apparatus 10 when finished; folding the mat assembly 20 into four (4) parallel sections forming a "W" shape; securing the apparatus 10 therein a compact folded form by fastening the hook-and-loop strap portions 55 to the corresponding hook-and-loop anchor portions 57; transporting and/or storing the apparatus 10 until needed again; and, benefiting from a portable, protective, and comfortable platform for an infant or toddler while utilizing the present invention 10.

The apparatus 10 may be effectively cleaned by wiping the plastic-coated bottom layer 22 using a damp and soapy cloth. Additionally, the upper layer 26 and foam rubber insert 35 may be removed and laundered in a conventional manner, if desired, by unzipping the zipper 28 and removing said upper layer 26 and foam rubber insert 35 from the mat assembly 20.

It is further understood that the apparatus 10 may be alternately utilized using various existing umbrellas to obtain desired shade for the occupying infant.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A portable mat, convertible between a stored configuration and a deployed configuration, comprising:

a padded textile water-resistant mat body, comprising a plurality of layers further comprising:

a compliant water-resistant bottom layer, having an upper surface and a bottom surface;

a compliant upper layer having an outer perimeter edge affixed to said upper surface of said bottom layer and disposed thereon, further comprising a fastening means on an upper surface of said providing access to an interior space between said upper layer and said bottom layer; and, a padded insert removably disposed within said interior space;

a securing means for securing said mat body in said stored configuration; and, a transporting means for transporting said mat body in said stored configuration;

wherein said portable mat is foldable in an accordion fashion to achieve said stored configuration such that said bottom layer is facing outwardly and said upper layer is concealed;

wherein said stored configuration comprises a first end and a second end;

wherein said mat body provides a barrier to a ground surface when laid upon in said deployed configuration; and, wherein said mat body provides a comfortable and protective surface to users when on said mat body.

2. The portable mat of claim 1, wherein said padded insert provides a comfortable soft compliant material.

3. The portable mat of claim 2, wherein said bottom layer further comprises a plastic or latex-coated cotton fabric panel.

4. The portable mat of claim 3, wherein said bottom layer further comprises a padded edge upstanding from a top perimeter of said bottom layer, thereby providing a soft compliant barrier to said ground surface.

5. The portable mat of claim 4, wherein said upper layer further comprises a plastic or latex-coated cotton fabric panel.

6. The portable mat of claim 5, wherein said fastening means is indented at an equidistant location along three sides of said upper layer and further comprises a zipper.

7. The portable mat of claim 4, wherein said padded insert comprises a urethane foam.

8. The portable mat of claim 4, wherein said securing means further comprises:

a first set of securing means located on opposing outer edges of said bottom surface of said bottom layer; and, a second set of securing means located on an intermediate location of said bottom surface of said bottom layer;

wherein said first set of securing means secures said portable mat at said first end of said stored configuration; and, wherein said second set of securing means secures said portable mat at said second end of said stored configuration.

9. The portable mat of claim 8, wherein said first set of securing means and said second set of securing means each further comprises a pair of correspondingly mating hook-and-loop-type fasteners.

10. The portable mat of claim 8, wherein said transporting means further comprises a pair of length adjustable carrying straps affixed on opposing outer edges of said bottom surface of said bottom layer, adjacent to said first set of securing means;

wherein said pair of carrying straps are disposed adjacent to each other at said first end when said portable mat is in said stored configuration, thereby enabling a user to grasp both of said pair of carrying straps with a single hand.

11. The portable mat of claim 3, further comprising an umbrella tube, comprising a cylindrical structure affixed along a longitudinal surface and coextending with a width of said padded edge, further comprising a closed end portion and an open end portion;

wherein said umbrella tube receives an umbrella inserted therein.

12. A portable mat, convertible between a stored configuration and a deployed configuration, comprising:

a padded textile water-resistant mat body, comprising:

a compliant water-resistant bottom layer, having an upper surface and a bottom surface, further comprising a padded edge upstanding from a top perimeter of said bottom layer;

a compliant upper layer having an outer perimeter edge affixed to said upper surface of said padded edge portion of said bottom layer and disposed thereon, further comprising a fastening means on an upper surface of said providing access to an interior space between said upper layer and said bottom layer; and, a padded insert removably disposed within said interior space;

wherein said padded edge and said padded insert provide a soft and compliant barrier to a ground surface;

a first set of securing means located on opposing outer edges of said bottom surface of said bottom layer, thereby securing said portable mat at a first end of said stored configuration;

a second set of securing means located on an intermediate location of said bottom surface of said bottom layer, thereby securing said portable mat at a second end of said stored configuration; and, a pair of length adjustable carrying straps affixed on opposing outer edges of said bottom surface of said bottom layer, adjacent to said first set of securing means;

wherein said pair of carrying straps are disposed adjacent to each other at said first end when said portable mat is in said stored configuration, thereby enabling a user to grasp both of said pair of carrying straps with a single hand;

wherein said portable mat is foldable in an accordion fashion to achieve said stored configuration such that said bottom layer is facing outwardly and said upper layer is concealed;

wherein said mat body provides a barrier to said ground surface when laid upon in said deployed configuration; and, wherein said mat body provides a comfortable and protective surface to users when on said mat body.

13. The portable mat of claim 12, wherein said bottom layer further comprises a plastic or latex-coated cotton fabric panel.

14. The portable mat of claim 12, wherein said upper layer further comprises a plastic or latex-coated cotton fabric panel.

15. The portable mat of claim 12, wherein said fastening means is indented at an equidistant location along three sides of said upper layer and further comprises a zipper.

16. The portable mat of claim 12, wherein said padded insert comprises a urethane foam.

17. The portable mat of claim 12, wherein said first set of securing means and said second set of securing means each further comprises a pair of correspondingly mating hook-and-loop-type fasteners.

18. The portable mat of claim 12, further comprising an umbrella tube, comprising a cylindrical structure affixed along a longitudinal surface and coextending with a width of said padded edge, further comprising a closed end portion and an open end portion;

wherein said umbrella tube receives an umbrella inserted therein.

* * * * *